US010342354B2

(12) United States Patent
Partridge

(10) Patent No.: US 10,342,354 B2
(45) Date of Patent: Jul. 9, 2019

(54) MODIFIABLE SEAT

(71) Applicant: Thomas A. Partridge, Angola, NY (US)

(72) Inventor: Thomas A. Partridge, Angola, NY (US)

( * ) Notice: Subject to any disclaimer, the term of this patent is extended or adjusted under 35 U.S.C. 154(b) by 329 days.

(21) Appl. No.: 15/376,559

(22) Filed: Dec. 12, 2016

(65) Prior Publication Data

US 2017/0164752 A1 Jun. 15, 2017

Related U.S. Application Data

(60) Provisional application No. 62/266,801, filed on Dec. 14, 2015.

(51) Int. Cl.

| | |
|---|---|
| ***A47C 1/14*** | (2006.01) |
| ***A47C 1/16*** | (2006.01) |
| ***A47C 4/28*** | (2006.01) |
| ***A47C 4/52*** | (2006.01) |
| ***A47C 4/30*** | (2006.01) |

(Continued)

(52) U.S. Cl.

CPC ..... *A47C 7/66* (2013.01); *A47C 1/143* (2013.01); *A47C 1/16* (2013.01); *A47C 4/28* (2013.01); *A47C 4/30* (2013.01); *A47C 4/44* (2013.01); *A47C 4/52* (2013.01); *A47C 7/402* (2013.01); *A47C 7/62* (2013.01); *A47C 7/666* (2018.08)

(58) Field of Classification Search

CPC .. A47C 1/14; A47C 1/143; A47C 1/16; A47C 1/146; A47C 4/00; A47C 4/28; A47C 4/30; A47C 4/42; A47C 4/44; A47C 4/52; A47C 5/04; A47C 5/06; A47C 7/407; A47C 7/42; A47C 7/402; A47C 7/60; A47C 7/66; A47C 7/666

See application file for complete search history.

(56) References Cited

U.S. PATENT DOCUMENTS 1,480,286 A * 1/1924 Morganstern ..... A47C 1/146 135/96
1,721,366 A * 7/1929 Backstrom ..... A47C 1/16 297/350

(Continued)

FOREIGN PATENT DOCUMENTS

CA 2951484 A1 * 6/2017 ..... A47C 1/143
DE 202013104794 U1 * 1/2014 ..... A47C 1/16

(Continued)

*Primary Examiner* — Ryan D Kwiecinski
(74) *Attorney, Agent, or Firm* — Harris Beach PLLC; Neal L. Slifkin

(57) ABSTRACT

An adjustable height, covered, foldable, configurable modifiable seat with a seat frame (comprising a bottom frame, a back frame, and an upper frame) and at least one frame opening defined by the contours of at least a portion of the seat frame. A bleacher hook is disposed on the seat frame. Lower hinges connect the bottom frame to the back frame and upper hinges connect the back frame to the upper frame. The lower and upper hinges can be locked to provide the frame with stability. A first support member is connected to the lower hinges and a second support member is connected to the upper hinges. A fabric is disposed over at least a portion of said seat frame and at least one frame opening. The modifiable seat is used by a user in a first, second, third, or fourth configuration.

37 Claims, 17 Drawing Sheets

(51) Int. Cl.

| | |
|---|---|
| ***A47C 4/44*** | (2006.01) |
| ***A47C 7/62*** | (2006.01) |
| ***A47C 7/66*** | (2006.01) |
| ***A47C 7/40*** | (2006.01) |

(56) References Cited

U.S. PATENT DOCUMENTS 2,561,886 A * 7/1951 Rikelman ..... A47C 4/42 297/357
2,647,563 A * 8/1953 Bishop ..... A47C 1/16 297/350
2,725,925 A * 12/1955 Sanderson ..... A47C 1/16 297/252
3,155,427 A * 11/1964 Necessary ..... A47C 1/16 135/149
4,775,182 A * 10/1988 von Hoffman ..... A47C 1/14 297/350
D361,439 S * 8/1995 Patton ..... D25/16
6,036,262 A * 3/2000 Shahid ..... A47C 1/143 297/184.15
8,794,699 B1 * 8/2014 Rudolfo ..... A47C 4/20 297/118
2002/0112752 A1 * 8/2002 Blakney ..... A47C 7/66 135/96
2013/0017775 A1 * 1/2013 Chwala ..... F24F 7/025 454/354
2013/0127213 A1 * 5/2013 Combs ..... A47C 7/66 297/184.11
2014/0265462 A1 * 9/2014 Fleming ..... A47C 7/66 297/180.14
2015/0091351 A1 * 4/2015 Chlapaty ..... A47C 15/004 297/313
2015/0282626 A1 * 10/2015 Rowe, Jr. ..... A47C 7/66 135/96

FOREIGN PATENT DOCUMENTS

DE 202016100415 U1 * 2/2016 ..... A47B 37/04
WO WO-03011077 A1 * 2/2003 ..... A47C 1/143

* cited by examiner

MODIFIABLE SEAT

CROSS-REFERENCE TO RELATED APPLICATIONS

The present invention claims priority from pending US Provisional patent application, Ser. No. 62/266,801, filed Dec. 14, 2015, titled "MODIFIABLE SEAT," the disclosure of which is incorporated herein by reference in its entirety.

TECHNICAL FIELD

The present invention relates to the field of seats; more particularly, to an adjustable height, covered, foldable, configurable modifiable seat for use by a user.

BACKGROUND OF THE INVENTION

Individuals seated outdoors must often endure environmental factors such as precipitation, uncomfortable temperatures, wind, insects, and other undesirable elements. Seated individuals may also desire a measure of privacy not provided by existing seats, regardless of where they are seated.

For example, individuals attending a sporting event in inclement weather may be exposed to cold temperatures, wind, or rain. In addition, bleacher seats typically lack cushioning, and may be dirty, cold, or otherwise uncomfortable.

The modifiable seat of the present application provides various features to enhance the experience of a spectator or any individual seated outdoors, on bleachers, at the beach, or elsewhere, by providing, among other things, curtains to block precipitation and provide privacy for a user. The configurable nature of the modifiable seat facilitates such capabilities.

SUMMARY

In accordance with one embodiment the present invention provides an adjustable height, covered, foldable, configurable modifiable seat.

The modifiable seat is configurable for use as a seat by a user. The modifiable seat has components that are configurable to extend over and around the user and provide shielding from precipitation, sunlight or other potential nuisances. The modifiable seat has a seat frame with a bottom frame, a back frame, an upper frame (which may further comprise a lumbar support curve), and at least one frame opening. Each frame opening is defined by contours of the seat frame. The modifiable seat also has a bleacher hook disposed on the bottom frame, which allows the modifiable seat to be connected to, for example, a bleacher at a stadium.

Lower hinges pivotably connect the bottom frame to the back frame, lower brackets are connected to and support the bottom frame and are removably connected to the back frame by, for example, at least one bracket pin, which may be tethered to the modifiable seat with a tether, upper hinges pivotably connect the back frame to the upper frame, and upper brackets pivotably connect to the back frame and are removably connected to the upper frame (additionally, a clip may be disposed on each upper bracket). Moreover, a first support member is pivotably connected to the lower hinges, and a second support member is pivotably connected to the upper hinges. In addition, a fabric is disposed over at least a portion of the seat frame and at least one frame opening. At least one curtain extends from the fabric.

In an embodiment of the present invention, the fabric may further comprise at least one pocket, may be attached to the seat frame by tubes disposed on the fabric, and may be removably attached to the seat frame by fasteners on the tubes. Also, the modifiable seat may further comprise a rain shield with a rain shield rod, removably couplable to the curtain, and may also further comprise an umbrella holder. Further, the back frame of the modifiable seat may comprise at least one extender for adjusting the height of the back frame.

In an alternate embodiment of the present invention, the need for brackets is obviated. The lower hinges have locking pinholes, and pivotably connect the bottom frame to the back frame. Upper hinges with locking pinholes pivotably connect the back frame to the upper frame. Support pins are removably coupled with (and capable of locking) the lower hinges and the upper hinges. Each support pin may be tethered to the modifiable seat with a tether.

The curtain of the modifiable seat may comprise at least one window that is transparent or translucent and allows for light to cross from one side of the curtain to the other with little or no interference.

The seat frame of the modifiable seat may further comprise at least one screw hole, and the fabric may be removably attached to the seat frame by at least one fastening screw penetrating at least a portion the fabric and engaging with the screw hole.

In another alternate embodiment of the present invention, hinges pivotably connect the bottom frame to the back frame, folding brackets pivotably connect to and support the bottom frame and are pivotably connected to and support the back frame. Upper hinges pivotably connect the back frame to the upper frame, and folding brackets pivotably connect to and support the back frame and are pivotably connected to and support the upper frame.

An embodiment of the present invention is configurable in a first configuration where at least a portion of the fabric is positioned over the user and at least one curtain is positioned next to the user providing shielding from precipitation or sunlight, a second configuration where the first support member and the second support member are positioned generally perpendicular to and below the back frame, with the curtains furled, a third configuration with the upper frame, the first support member, and the second support member folded against the back frame, with the curtains furled, and a fourth configuration with the upper frame, bottom frame, first support member, and second support member folded against the back frame, with the curtains furled.

BRIEF DESCRIPTION OF THE DRAWINGS

The present invention will now be described, by way of example, with reference to the accompanying drawings, in which.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the disclosure. Accordingly, the specification and drawings are to be regarded as illustrative rather than restrictive. It is to be further noted that the drawings are not to scale.

Figure 1:
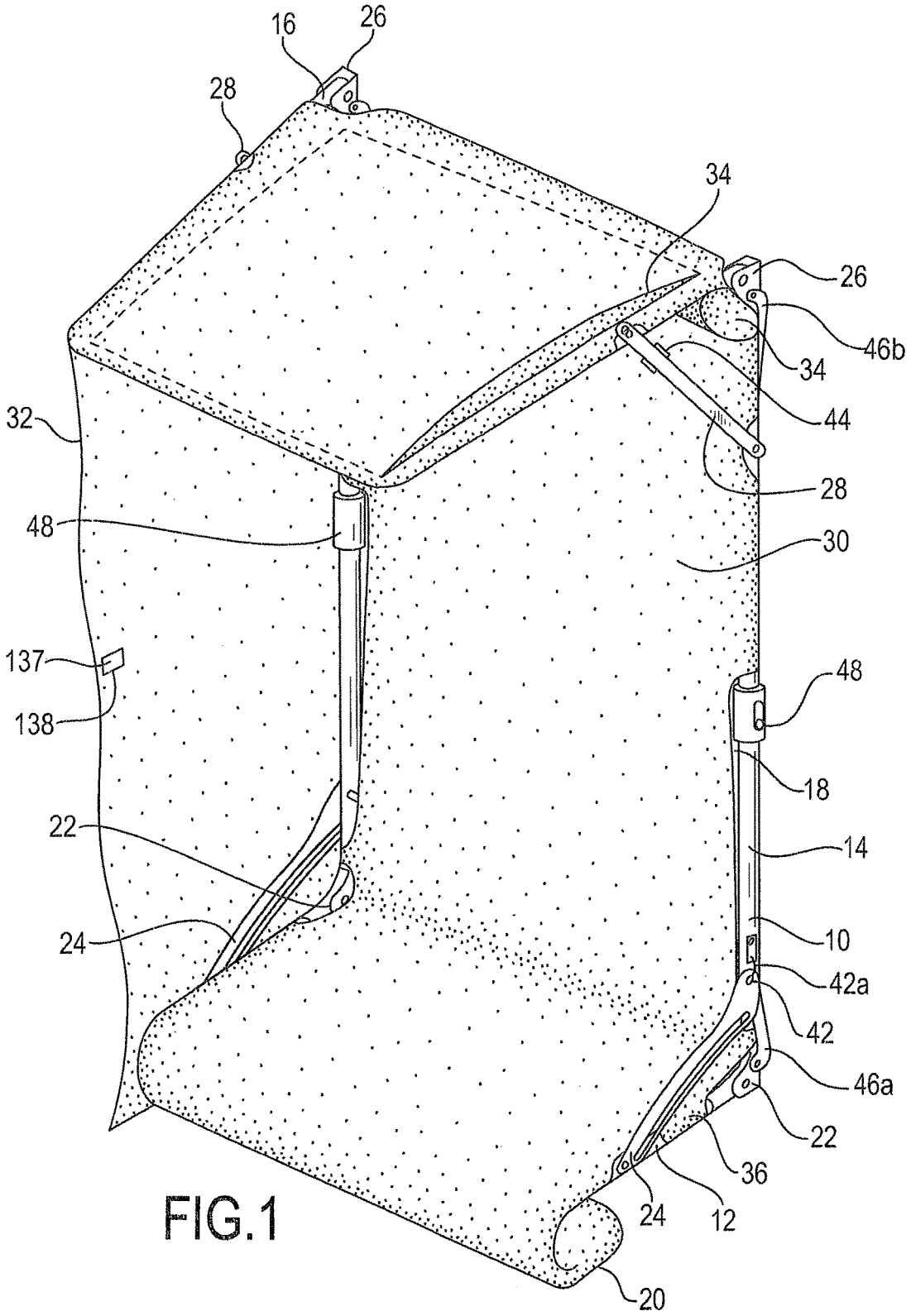
FIG. 1 is an isolinear view of an embodiment of a modifiable seat in accordance with the present application.
Figure 1D:
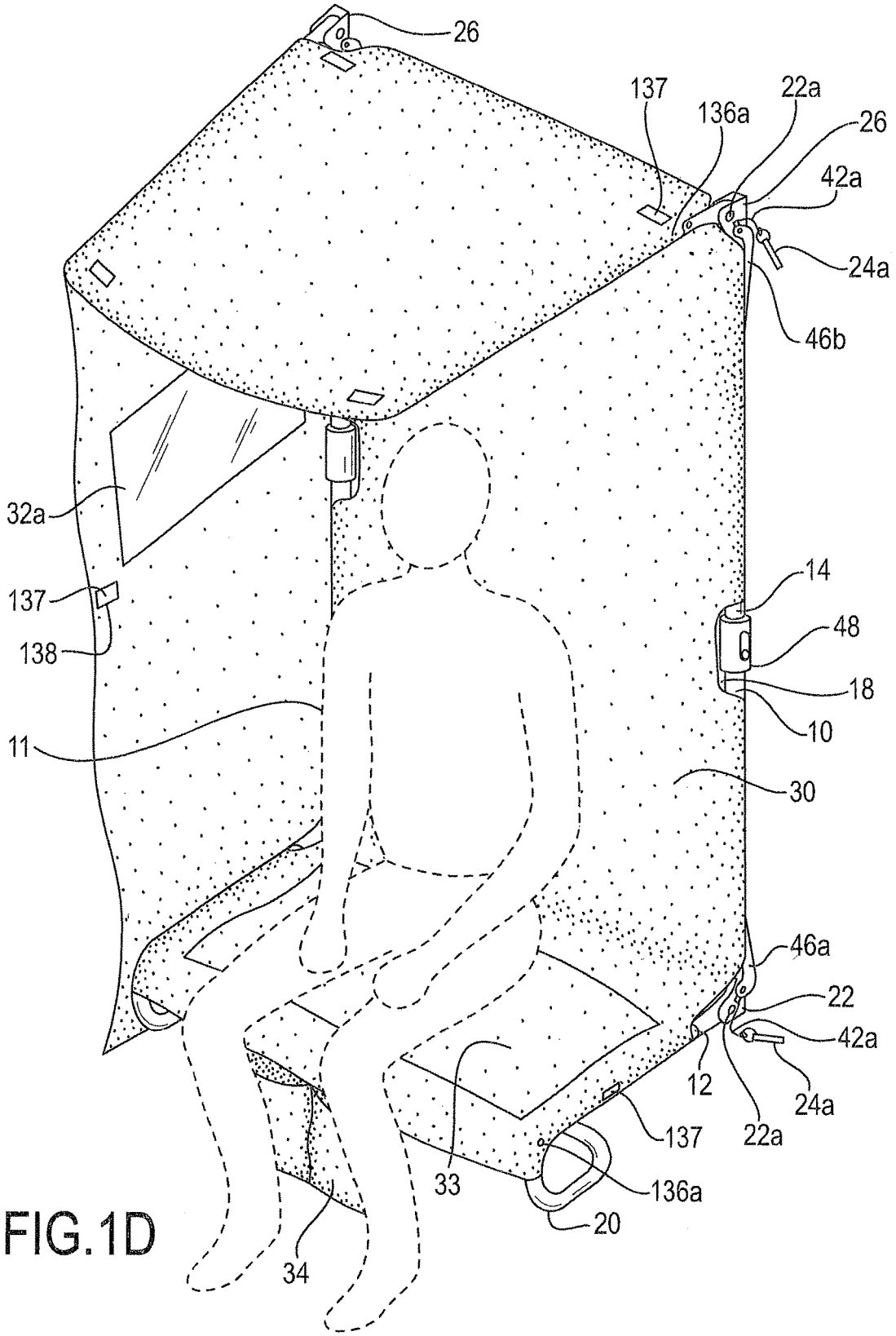
FIG. 1D is an isolinear view of an alternate embodiment of a modifiable seat in accordance with the present application, with a user.
Figure 2:
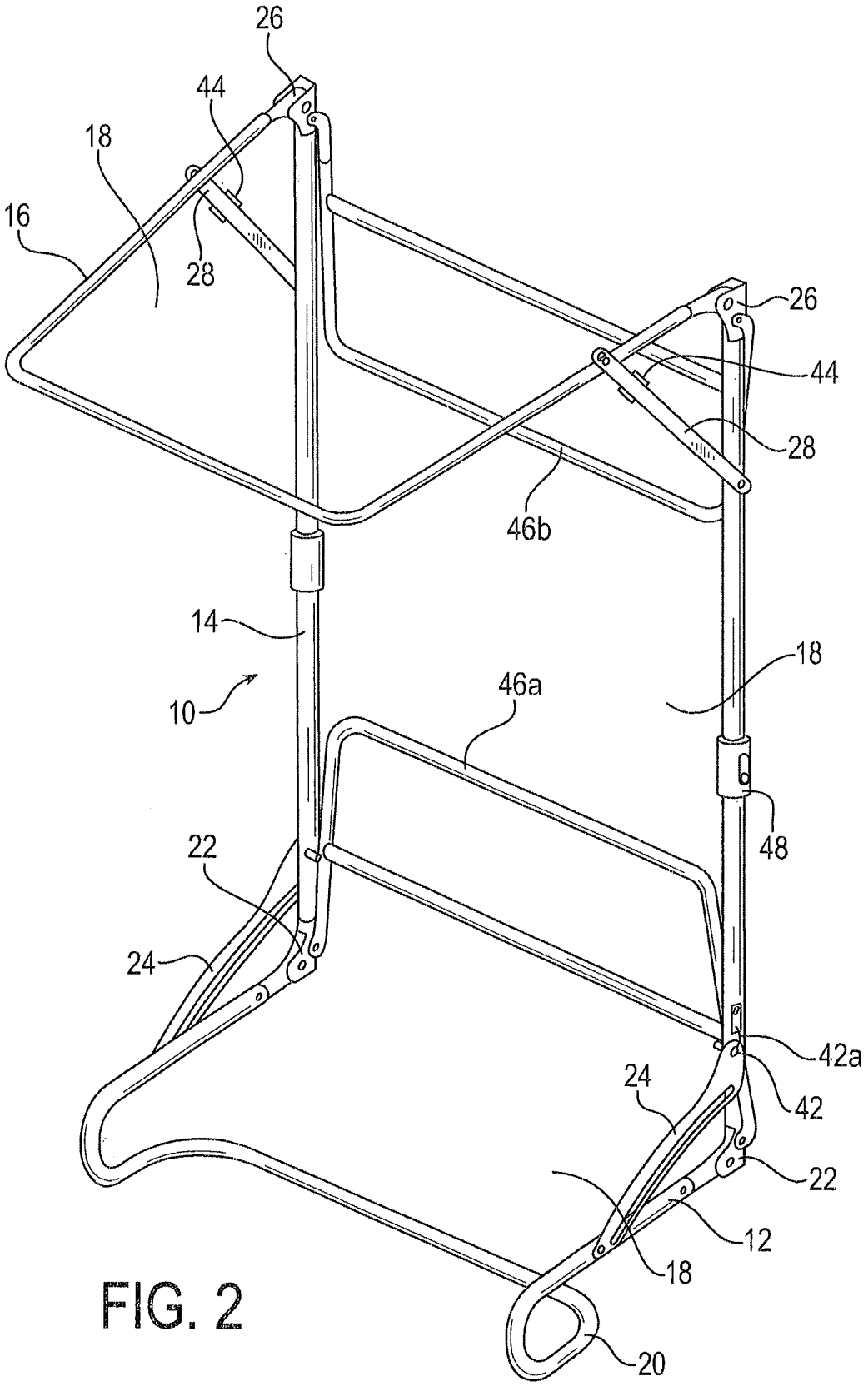
FIG. 2 is an isolinear view of an embodiment of a modifiable seat frame in accordance with the present application.

FIGS. 1 and 2 show one embodiment of a modifiable seat with a seat frame 10. The modifiable seat is to be used by a user 11 (e.g., as shown in an embodiment of a modifiable seat shown in FIG. 1D), who will sit, recline, or otherwise rest on the modifiable seat and benefit from the support, comfort and protection offered thereby. The seat frame 10 has a bottom frame 12, a back frame 14, and an upper frame 16. The seat frame 10 further comprises one or more frame openings 18 whose perimeters are defined by the contours of the seat frame 10.

The seat frame 10 may be removably coupled with a bleacher bench, a stadium chair, or other type of seat that may be found at an outdoor sporting venue or other venue by a bleacher hook 20 disposed on the bottom frame 12. In one embodiment the bleacher hook 20 is an extension of the bottom frame 12.

Lower hinges 22 connect the bottom frame 12 to the back frame 14. In one embodiment the lower hinges 22 are adjustable locking ratchet-type lower hinges 22. The lower hinges 22 allow the bottom frame 12 to pivot to and from the back frame 14 for storage and adjustment of the modifiable seat.

Lower brackets 24 may be connected to the bottom frame 12. In one embodiment, the lower brackets 24 are removably attached to the back frame 14. This allows for the bottom frame 12 to be maintained in a fixed position relative to the back frame 14.

Figure 2A:
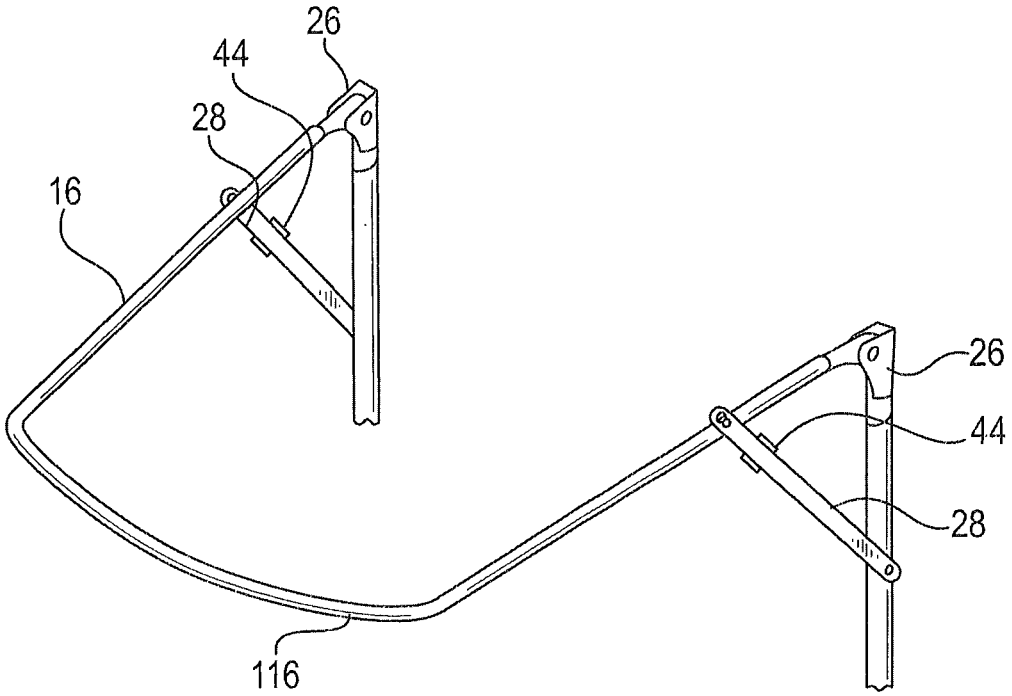
FIG. 2A is an isolinear view of a portion of an alternate embodiment of a modifiable seat showing an upper frame with a lumbar support curve.

Upper hinges 26 connect the back frame 14 to the upper frame 16. In one embodiment the upper hinges 26 are adjustable locking ratchet-type upper hinges 26. The upper hinges 26 allow the back frame 14 to pivot to and from the upper frame 16 for storage and adjustment of the modifiable seat. Thus, the upper frame 16 may pivot into a position where it is positioned approximately parallel to the back frame 14, as shown in an embodiment of a modifiable seat shown in FIG. 8, providing lumbar support for a user 11 seated in the modifiable seat. In an alternate embodiment, the upper frame 16 includes a lumbar support curve 116 configured to receive the back of a user 11, as shown in FIG. 2A.

In one embodiment, upper brackets 28 are pivotably connected to the back frame 14. The upper brackets 28 are removably attached to the upper frame 16. This allows for the back frame 14 to be maintained in a fixed position relative to the upper frame 16.

Figure 1A:
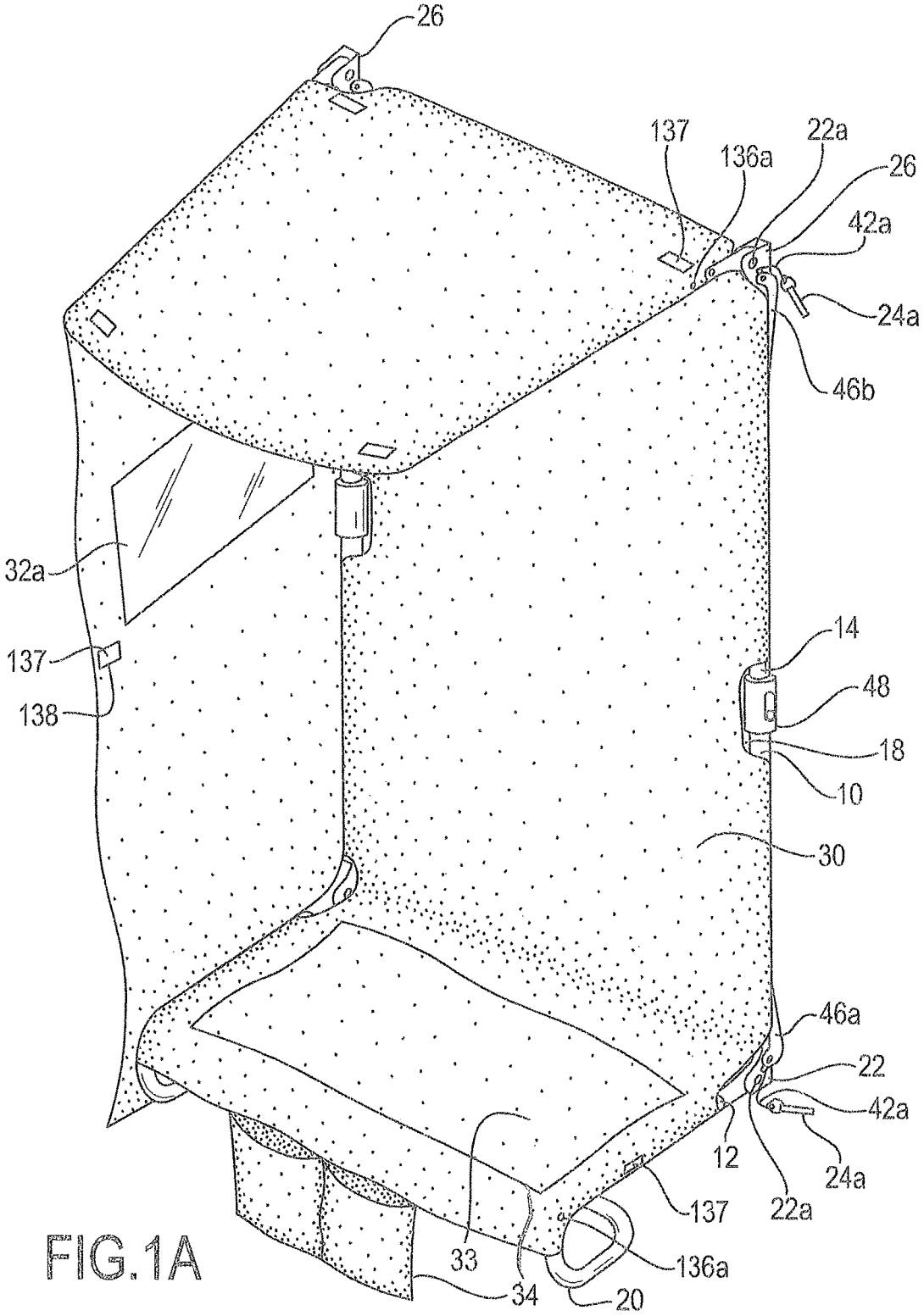
FIG. 1A is an isolinear view of an alternate embodiment of a modifiable seat in accordance with the present application.
Figure 1B:
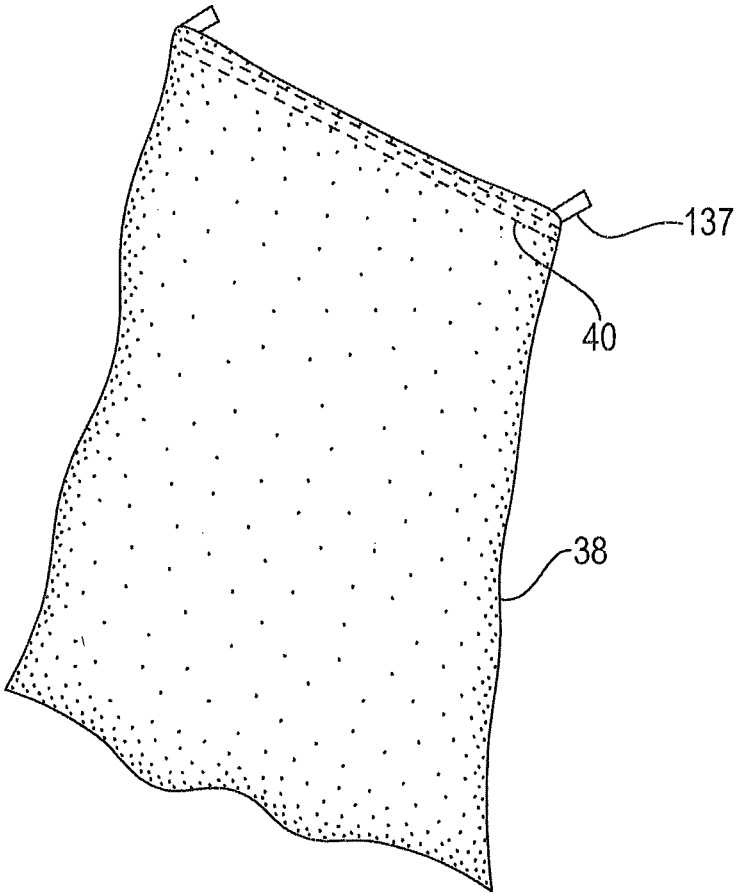
FIG. 1B is an isolinear view of an embodiment of a rain shield with a rain shield rod.
Figure 2B:
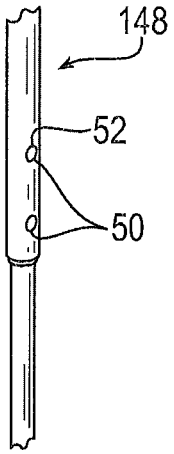
FIG. 2B is an isolinear view of a portion of an alternate embodiment of a modifiable seat showing a pin lock extender.
Figure 2C:
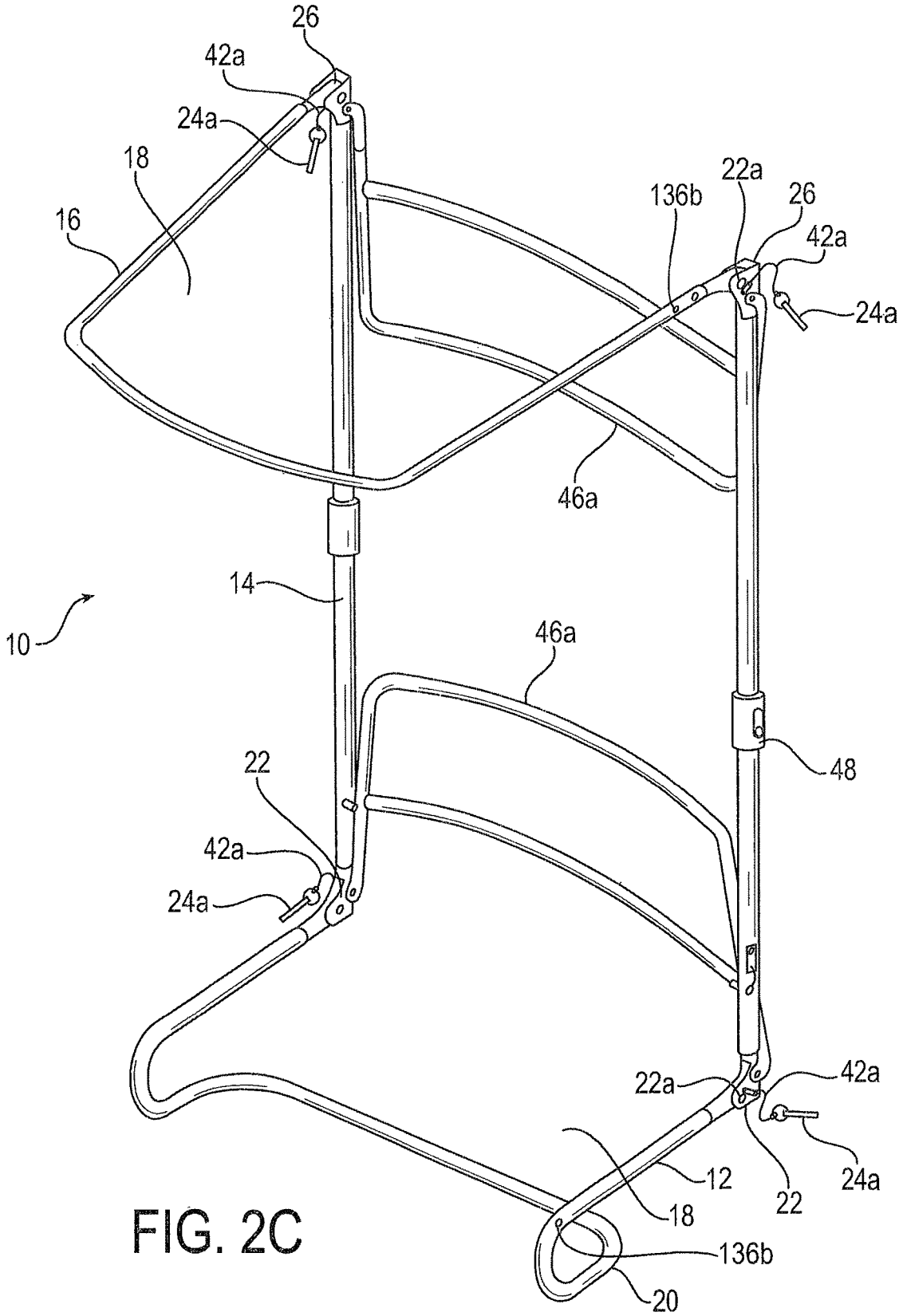
FIG. 2C is an isolinear view of an alternate embodiment of a modifiable seat frame in accordance with the present application.

The need for lower brackets 24 and upper brackets 28 is obviated in an alternate embodiment shown in FIGS. 1A and 2C. Those figures show a modifiable seat with support pins 24*a* that can engage with locking pinholes 22*a* disposed in the lower hinges 22, locking the lower hinges 22 and allowing the bottom frame 12 to be maintained in a fixed position relative to the back frame 14. Support pins 24*a* can engage with locking pinholes 22*a* disposed in the upper hinges 26, locking the upper hinges 26 and allowing the back frame 14 to be maintained in a fixed position relative to the upper frame 16. When inserted into a locking pinhole 22*a* in a lower hinge 22 or an upper hinge 26, a support pin 24*a* functions to stop the lower hinge 22 or upper hinge 26 from flexing or extending by obstructing such motion.

Figure 3:
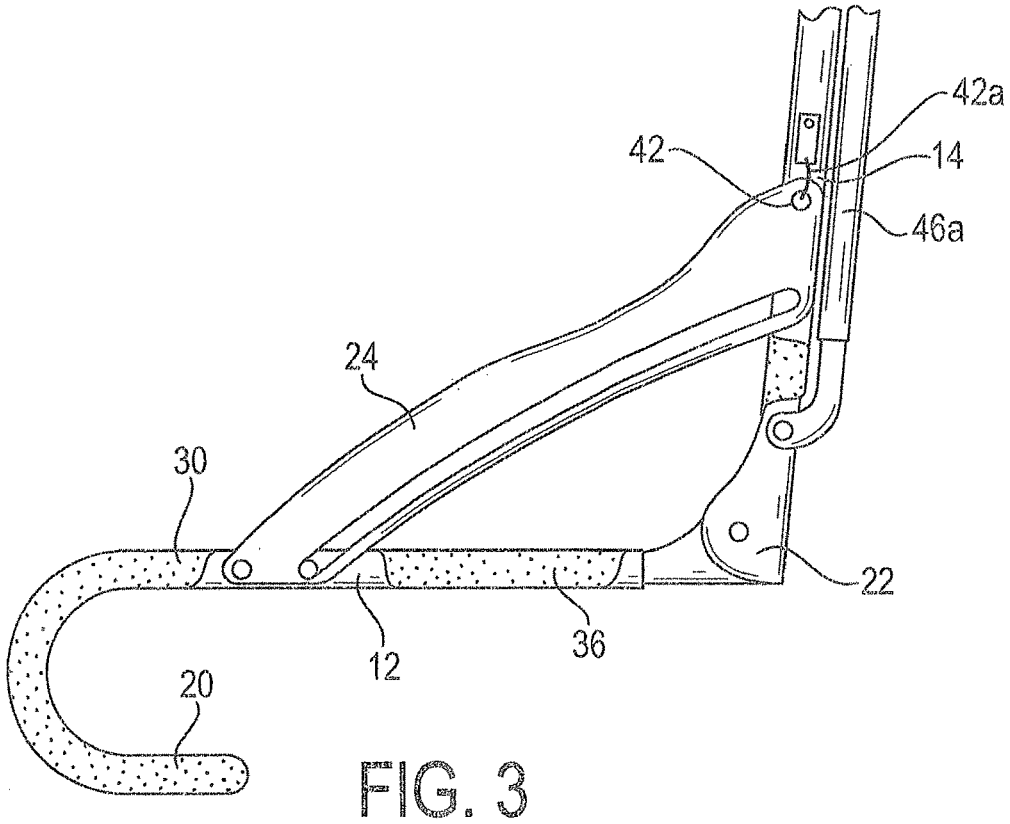
FIG. 3 is a side view of a portion of an embodiment of a modifiable seat in accordance with the present application showing a detailed view of, among other things, a bottom frame, a back frame, a bleacher hook, a lower hinge, and a lower bracket.
Figure 3A:
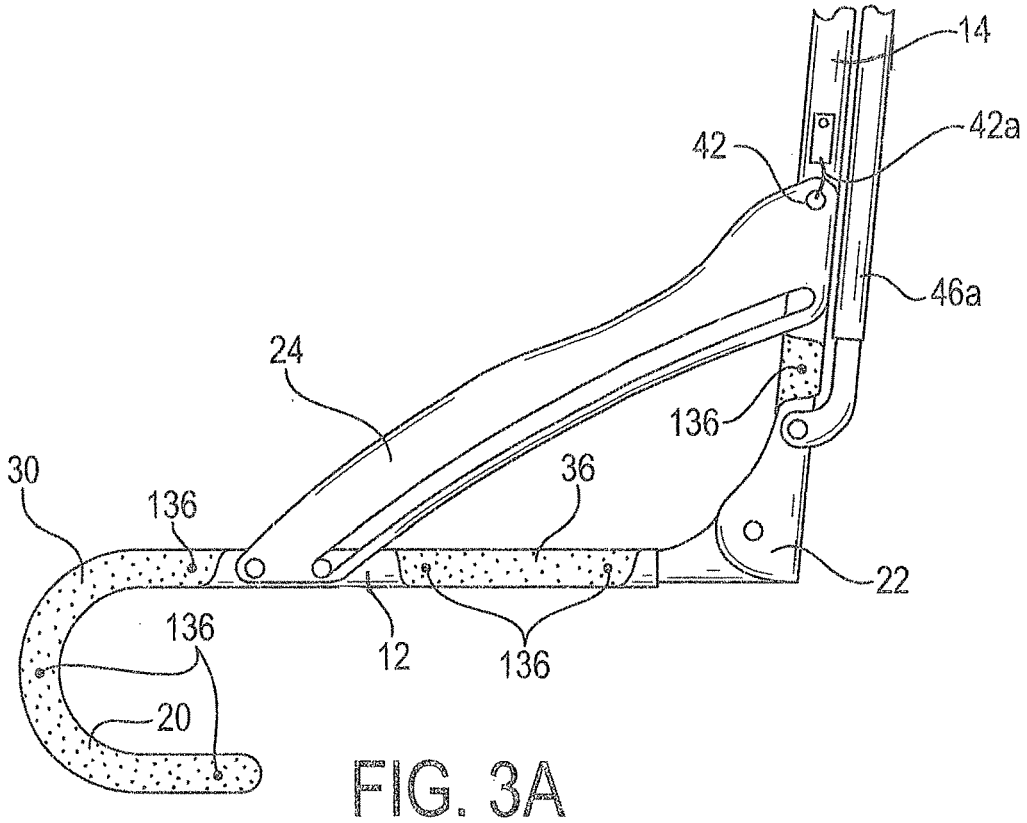
FIG. 3A is a side view of a portion of an embodiment of a modifiable seat in accordance with the present application showing a detailed view of, among other things, a bottom frame, a back frame, a bleacher hook, a lower hinge, a lower bracket, and a fastener.
Figure 3B:
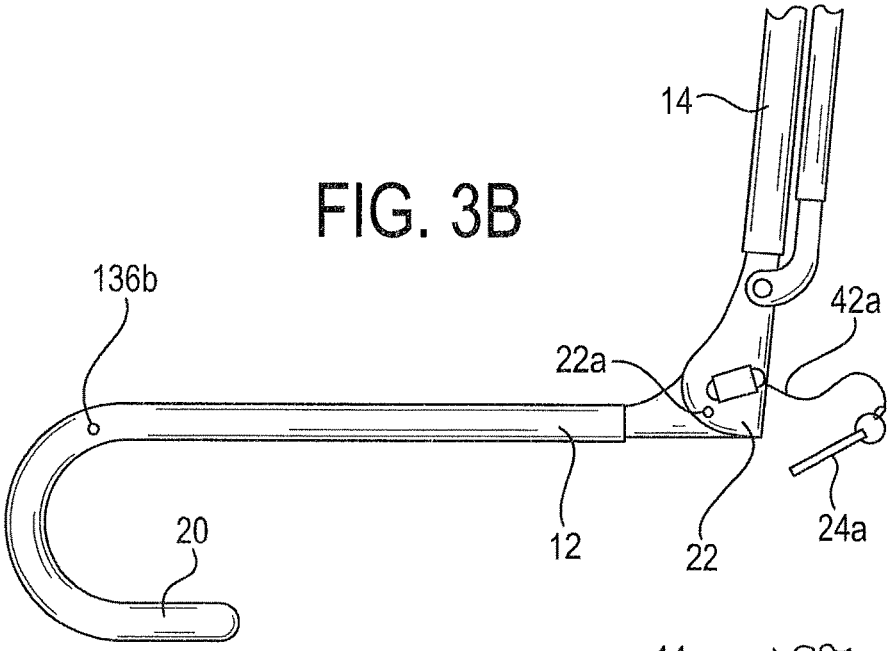
FIG. 3B is a side view of a portion of an alternate embodiment of a modifiable seat in accordance with the present application showing a detailed view of, among other things, a bottom frame, a back frame, a bleacher hook, a lower hinge, a support pin, and a screw hole.
Figure 5:
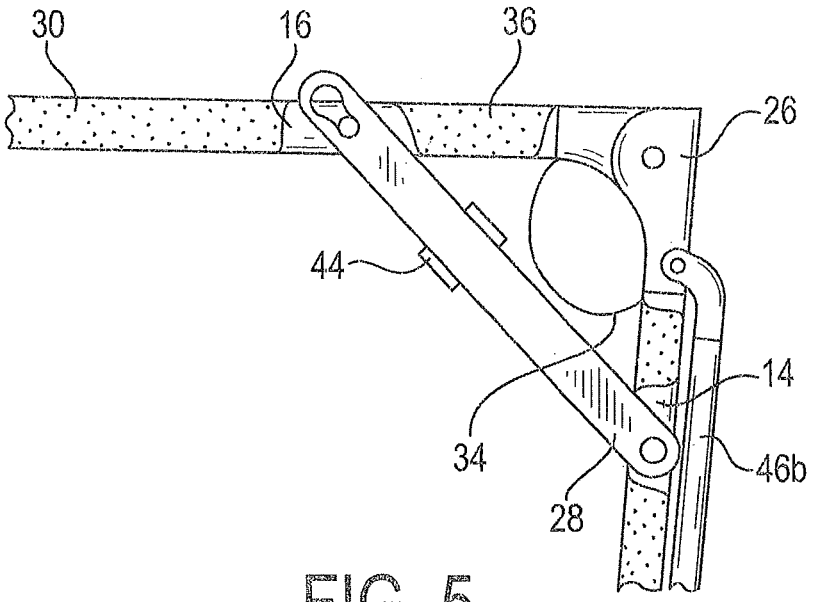
FIG. 5 is a side view of a portion of an embodiment of a modifiable seat in accordance with the present application showing a detailed view of, among other things, an upper frame, a back frame, an upper hinge, and an upper bracket.
Figure 5A:
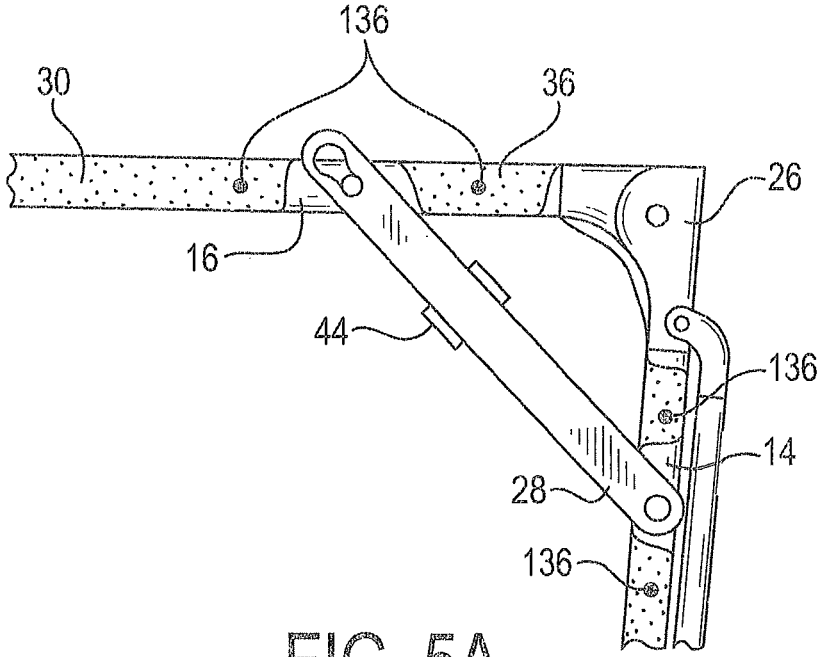
FIG. 5A is a side view of a portion of an embodiment of a modifiable seat in accordance with the present application showing a detailed view of, among other things, an upper frame, a back frame, an upper hinge, an upper bracket, and a fastener.
Figure 5B:
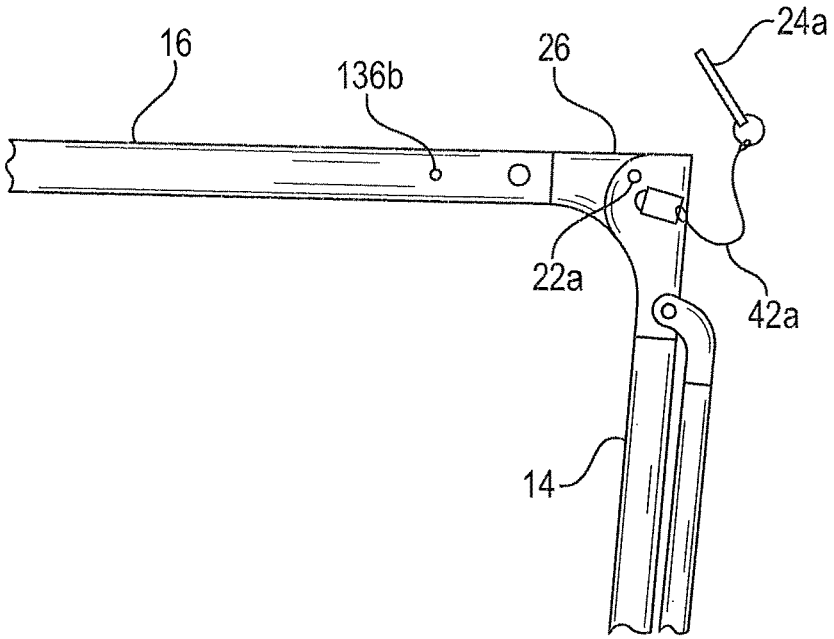
FIG. 5B is a side view of a portion of an embodiment of a modifiable seat in accordance with the present application showing a detailed view of, among other things, an upper frame, a back frame, an upper hinge, a support pin, and a screw hole.

Details of portions of an alternate embodiment with no lower brackets 24 and no upper brackets 28 are shown in FIGS. 3B and 5B. FIG. 3B shows a detailed view of, among other things, a bottom frame 12, a back frame 14, a bleacher hook 20, a lower hinge 22, a locking pinhole 22*a,* and a support pin 24*a.* FIG. 5B shows a detailed view of, among other things, an upper frame 16, a back frame 14, an upper hinge 26, a locking pinhole 22*a,* and a support pin 24*a.* The support pins 24*a* may be attached to the modifiable seat with a tether 42*a.*

Figure 3C:
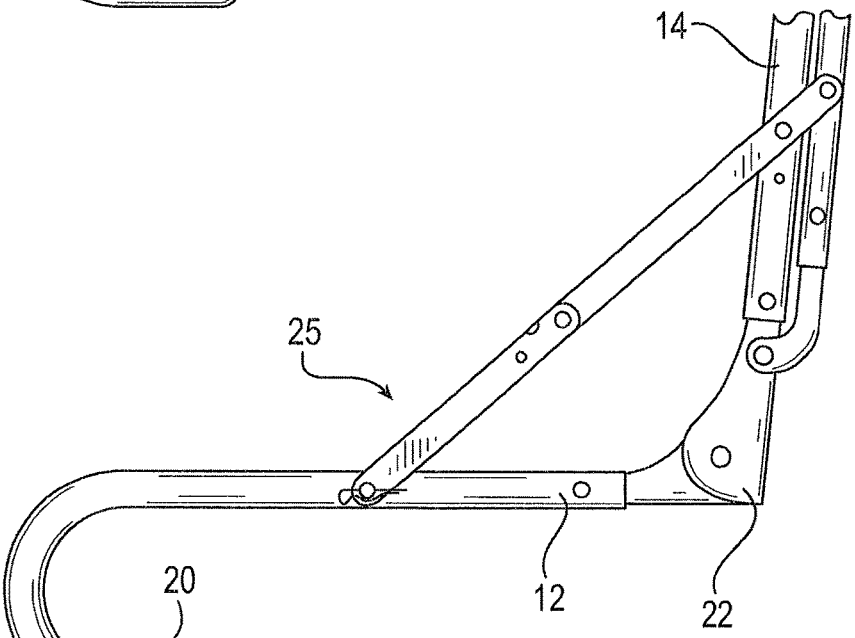
FIG. 3C is a side view of a portion of an alternate embodiment of a modifiable seat in accordance with the present application showing a detailed view of, among other things, a folding bracket.
Figure 5C:
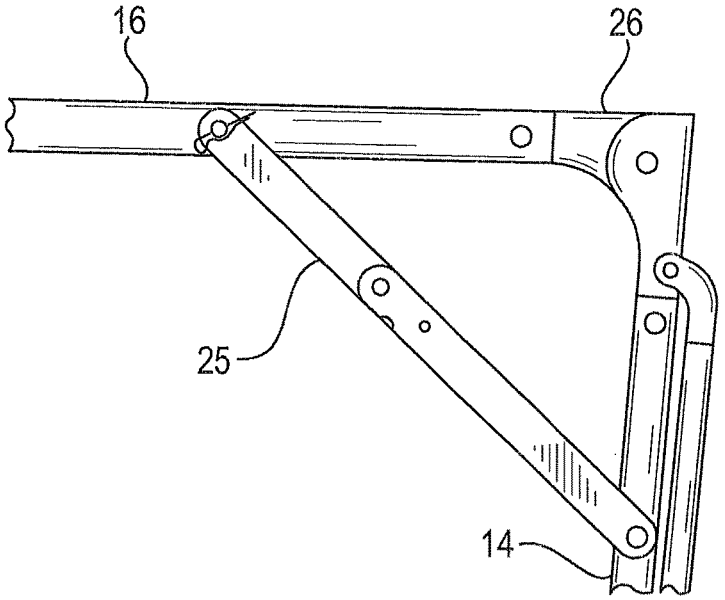
FIG. 5C is a side view of a portion of an alternate embodiment of a modifiable seat in accordance with the present application showing a detailed view of, among other things, a folding bracket.

In another alternate embodiment, folding brackets 25 are used in lieu of lower brackets 24, as shown in FIG. 3C, and in lieu of upper brackets 28, as shown in FIG. 5C. Folding brackets are capable of flexing and extending, and of reversibly locking when in the extended position. As shown in FIG. 3C, folding brackets 25 are pivotably connected to the bottom frame 12 and to the back frame 14, allowing the bottom frame 12 to be maintained in a fixed position relative to the back frame 14 when the folding bracket is locked in an extended position. As shown in FIG. 5C, folding brackets 25 are pivotably connected to the back frame 14 and are attached to the upper frame 16, allowing for the back frame 14 to be maintained in a fixed position relative to the upper frame 16 when the folding bracket in locked in an extended position.

As shown in FIG. 1, in one embodiment a fabric 30 is disposed over at least a portion of the seat frame 10. The fabric 30 is attached to the seat frame 10 and is disposed across at least part of the frame openings 18.

At least one curtain 32 extends from the fabric 30. The curtain 32 may be furled or unfurled while the modifiable seat is in use, to provide a user 11 with protection from precipitation, wind, or other nuisances. The curtain 32 also provides a user 11 with privacy.

Figure 1C:
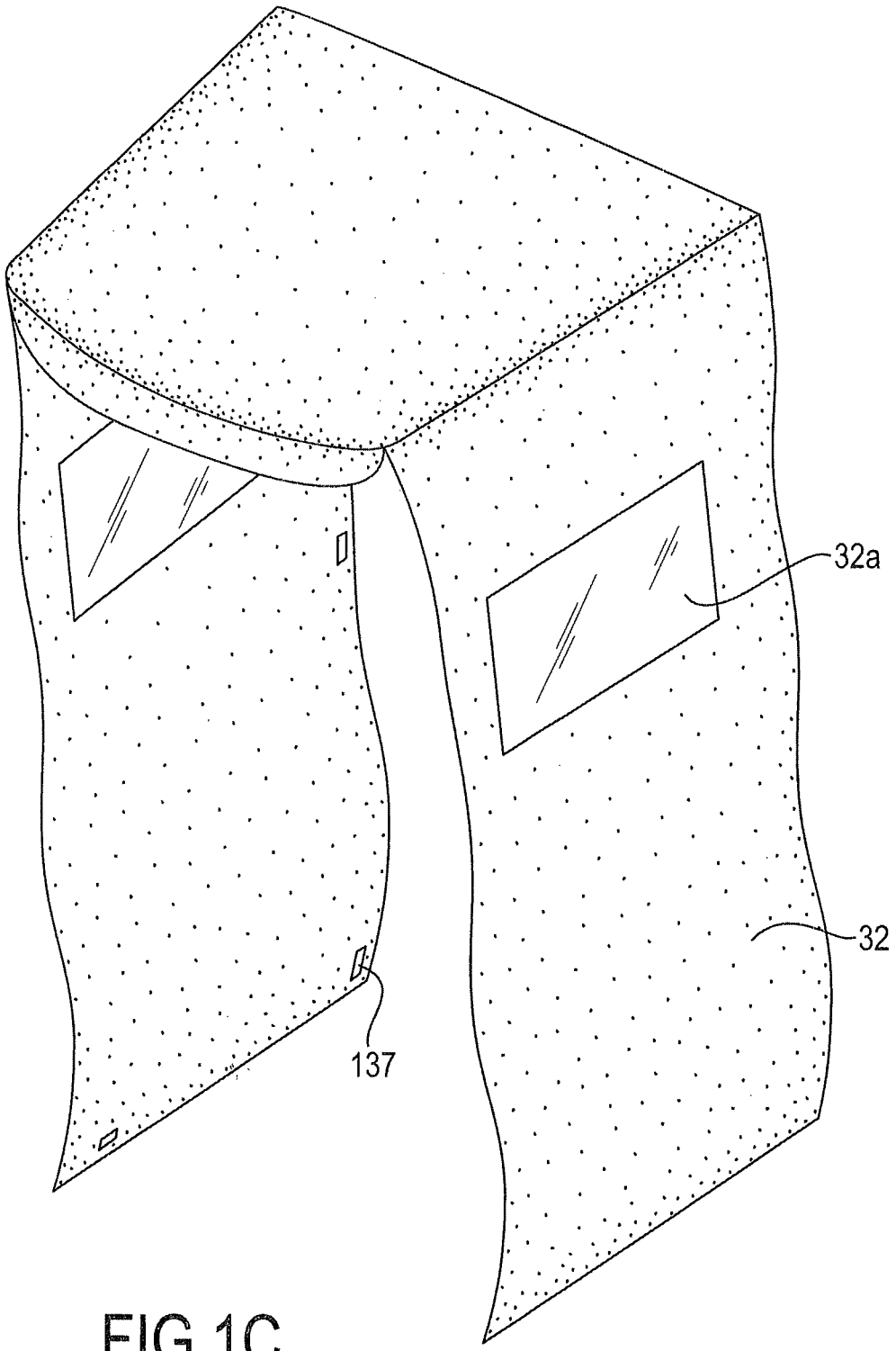
FIG. 1C is an isolinear view of an alternate embodiment of a curtain for a modifiable seat.

In an alternate embodiment, curtains 32 may be removably attached to the fabric 30 by hook-and-loop fasteners 137 disposed on the surface of the fabric 30 and the curtain 32, as shown in FIGS. 1A and 1C.

The fabric 30 has at least one pocket 34, which may be used to hold curtains 32, including for storage of furled curtains 32, or for storage of personal items such as an umbrella. Pockets 34 may be disposed on the modifiable seat as shown in FIG. 1 or FIG. 1A, for example. In one embodiment, a cushion 33 is inserted into a pocket 34 to provide cushioning for the modifiable seat, as shown in FIG. 1A.

In one embodiment, the fabric 30 is attached to the seat frame 10 by a plurality of tubes 36 stitched into the fabric 30 and disposed on at least a portion of the fabric 30, as shown in FIG. 1, 3 or 5, for example. Referring to FIGS. 3A and 5A, in an alternate embodiment the fabric 30 is removably attached to the seat frame 10 by a combination of a plurality of tubes 36 and a plurality of fasteners 136, which may be snap-type fasteners 136, disposed on at least a portion the tubes 36. The tubes 36 maintain their shape and are held in place on the seat frame 10 by the fasteners 136 when the fasteners 136 are fastened. The tubes 36 are released from the seat frame 10 when the fasteners 136 are unfastened, so that the fabric 30 may be removed from the seat frame 10.

In an alternate embodiment shown in FIG. 1A, the curtain 32 further comprises at least one window 32*a.* The window 32*a* is transparent or translucent and allows for light to cross from one side of the curtain 32 to the other with little or no interference. The window may be constructed of vinyl, air, or any other suitable matter.

FIGS. 1A and 2C show an alternate embodiment of a modifiable seat with the fabric 30 attached to the seat frame 10 with fastening screws 136*a.* Referring to FIGS. 3B and 5B, in the alternate embodiment, screw holes 136*b* perforate the seat frame 10 at various positions, so that the fastening screws 136*a* that attach the fabric 30 to the seat frame 10 may penetrate the screw holes 136*b* and engage with the seat frame 10. Hook-and-loop fasteners 137 are disposed at various positions on the fabric 30 to further secure the fabric 30 to the seat frame 10 (see FIG. 1A).

Figure 6:
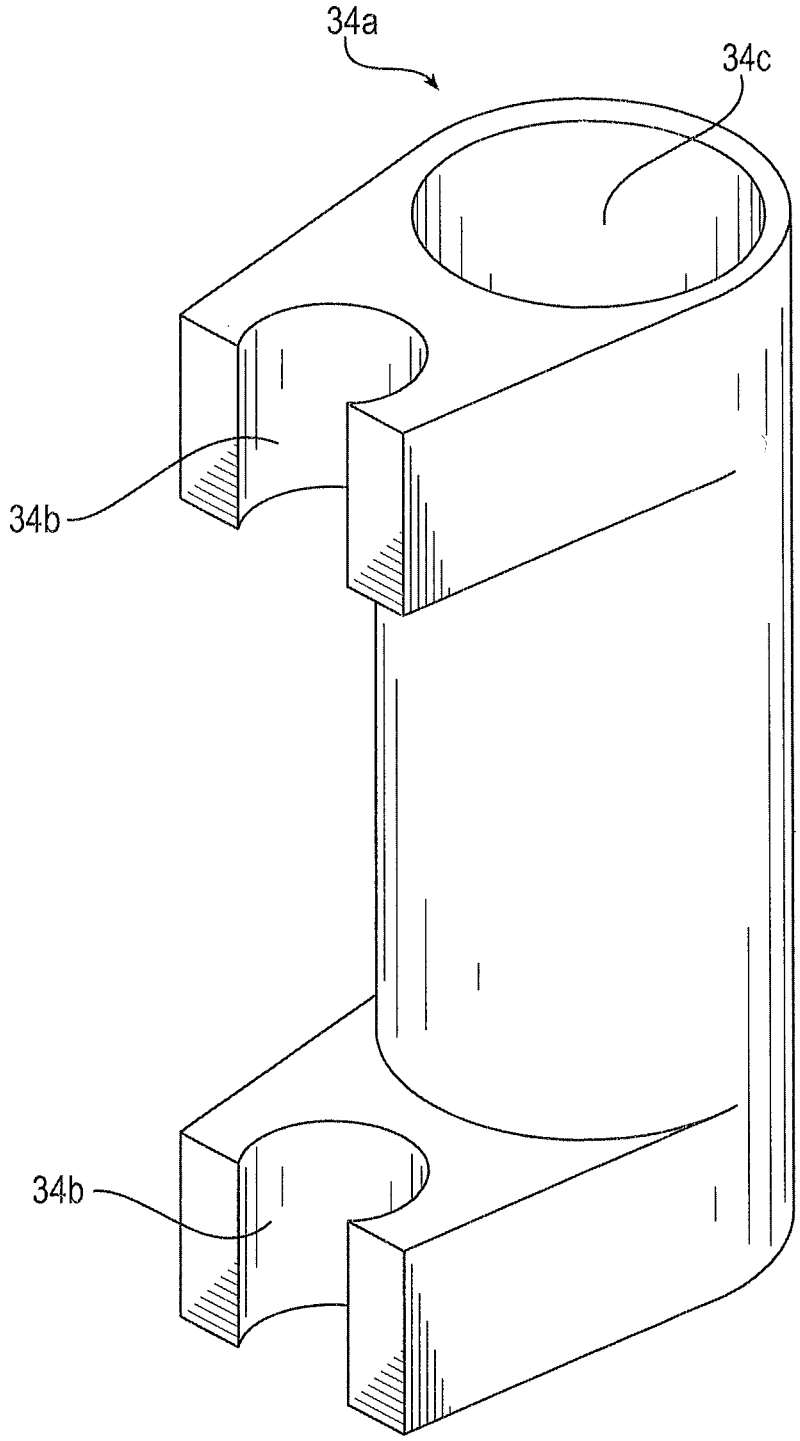
FIG. 6 is an isolinear view of an embodiment of an umbrella holder with a holder clasp and a coupling cavity.
Figure 7:
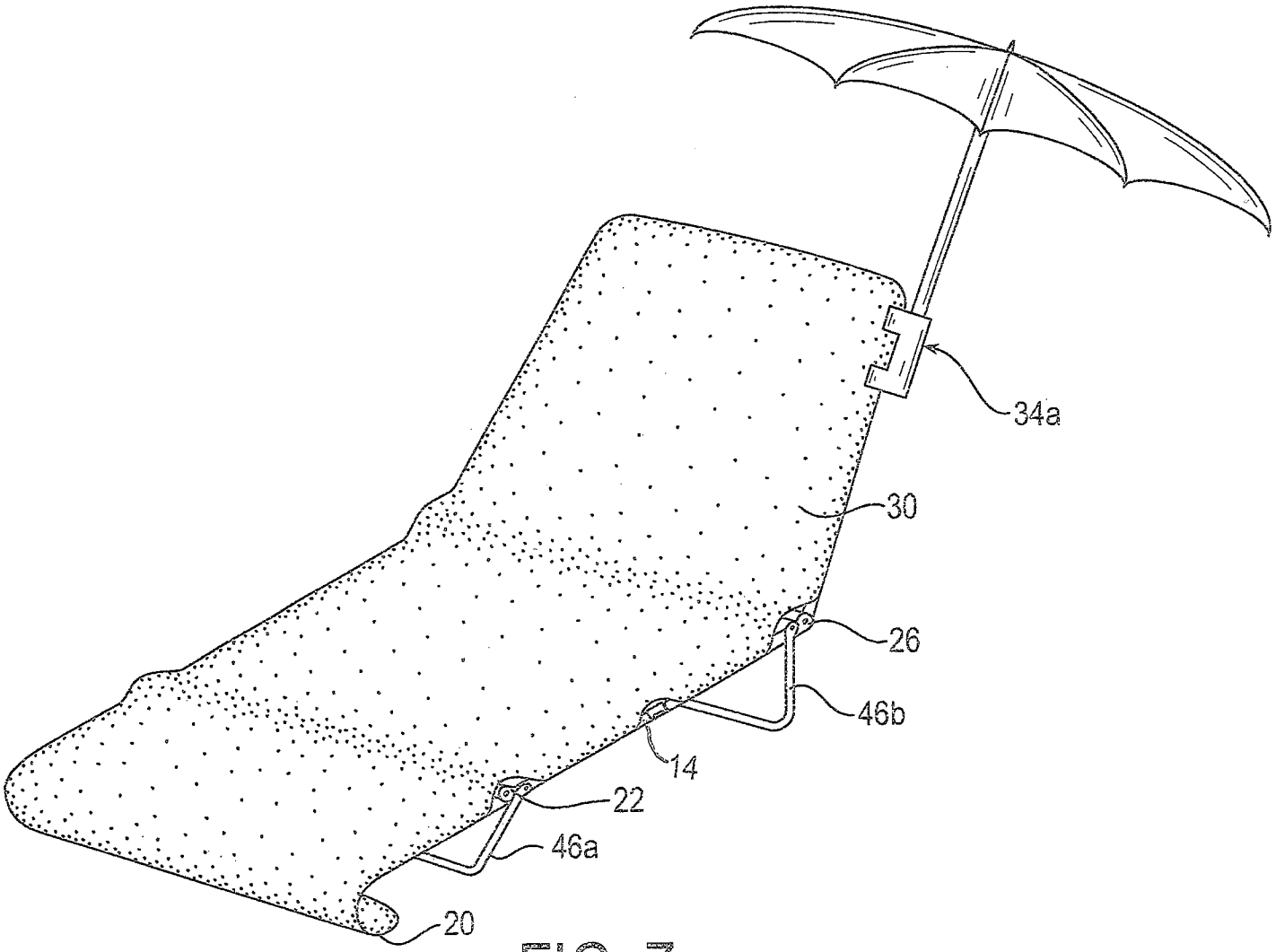
FIG. 7 is a view of an embodiment of an umbrella holder disposed on an embodiment of a modifiable seat.

In one embodiment, an umbrella holder 34*a,* shown in FIGS. 6 and 7, is removably attached to the upper frame 16 or other part of the modifiable seat and is positioned to hold an object, such as an umbrella. The umbrella holder 34*a* is attached to the upper frame 16 or other part of the modifiable seat via holder clasps 34*b.* The umbrella holder 34*a* includes a coupling cavity 34*c,* which may be cylindrical in shape, for receiving and coupling with an umbrella or other object.

Figure 6A:
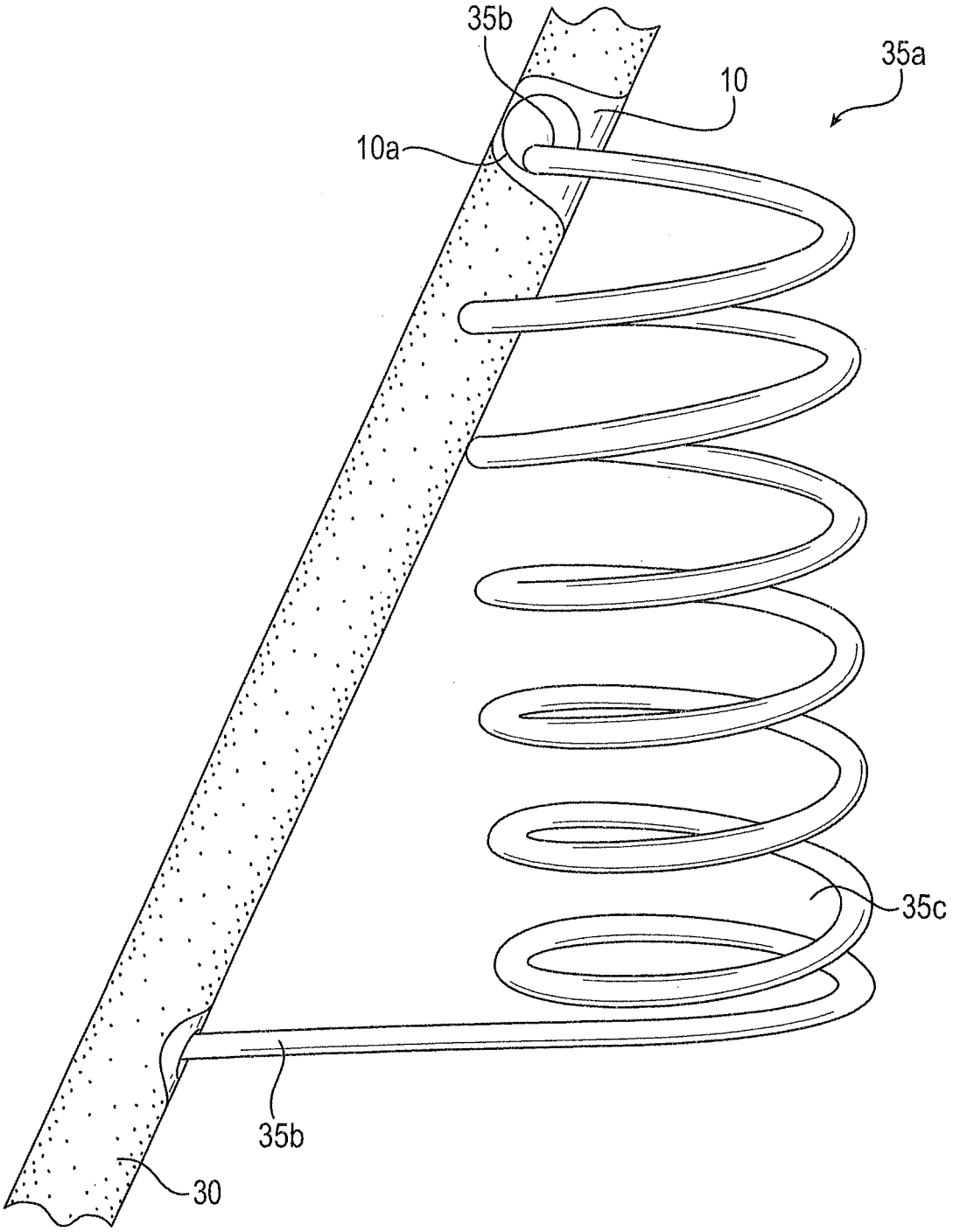
FIG. 6A is an isolinear view of an alternate embodiment of an umbrella holder with holder prongs and a coupling cavity, and a portion of an alternate embodiment of a modifiable seat frame showing coupling ports.

In an alternate embodiment shown in FIG. 6A, a coil umbrella holder 35*a* with holder prongs 35*b* and a coil cavity 35*c,* is removably attached to an alternate embodiment of a modifiable seat with a seat frame 10 that is perforated by one or more coupling ports 10*a.* The holder prongs 35*b* are configured to engage with the coupling ports 10*a* to support the coil umbrella holder 35*a* on the seat frame 10. The coil cavity 35*c* of the umbrella holder 35*a* is configured to engage with and support an umbrella or other object.

In one embodiment of a modifiable seat, a rain shield 38 with a rain shield rod 40 (shown in FIG. 1B) may be removably coupled by fasteners 136, including, but not limited to, hook and loop fasteners 137, with the curtains 32 on the modifiable seat (at rain shield attachment site 138 shown on FIGS. 1, 1A, and 1D) and functions as a barrier to precipitation, wind, or other nuisances. The rain shield 38 is made of material that is suitable for blocking such nuisances, and that may be supported by the rain shield rod 40.

Figure 4:
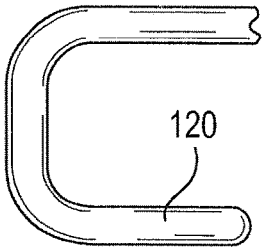
FIG. 4 is a side view of a portion of an alternate embodiment of a modifiable seat in accordance with the present application showing a detailed view of a squared crook type bleacher hook.

Referring to FIG. 3, a bleacher hook 20 may be in the form of a semicircular bleacher hook 20. In an alternate embodiment, a bleacher hook in the form of a squared crook 120 is utilized, as shown in FIG. 4.

Referring back to FIGS. 1 and 2, lower hinges 22 connect the bottom frame 12 to the back frame 14. The lower hinges 22 allow the bottom frame 12 to pivot to and from the back frame 14 for storage and adjustment of the modifiable seat.

In one embodiment (a detail of which is shown in FIG. 3), the lower brackets 24 are pivotably connected to the bottom frame 12. Bracket pins 42, tethered to the modifiable seat by a tether 42*a,* couple with and removably attach the lower brackets 24 to the back frame 14 and allow for the bottom frame 12 to be maintained in a fixed position relative to the back frame 14. The bracket pins 42 may be uncoupled from the lower brackets 24 and back frame 14, while remaining tethered to the modifiable seat by the tether 42*a,* so that the bottom frame 12 may pivot away from the back frame 14, allowing, for example, the angle between the bottom frame 12 and the back frame 14 to be approximately 180 degrees.

Referring to FIGS. 1, 2, and 5, the upper hinges 26 connect the back frame 14 to the upper frame 16. The upper hinges 26 allow the back frame 14 to pivot to and from the upper frame 16 for storage and adjustment of the modifiable seat.

In one embodiment (a detail of which is shown in FIG. 5), the upper brackets 28 are pivotably connected to the back frame 14 and are removably attached to the upper frame 16. This allows for the back frame 14 to be maintained in a fixed position relative to the upper frame 16. In one embodiment, clips 44 disposed on each of the upper brackets 28 removably couple with the back frame 14 to secure the upper brackets 28 to the back frame 14 in a fixed fashion (when the upper bracket 28 is detached from the upper frame 16) so that the upper brackets 28 do not pivot relative to the back frame 14 when the clips 44 are coupled with the back frame 14.

As shown in FIGS. 2 and 2C, first support member 46*a* is attached the lower hinge 22 so that it may pivot independently of the back frame 14 and the bottom frame 12. A second support member 46*b* is attached to the upper hinge 26 so that it may pivot independently of the back frame 14 and the upper frame 16. The first support member 46*a* and second support member 46*b* are each capable of pivoting away from the back frame 14 by approximately 90 degrees, so that the first support member 46*a* and the second support member 46*b* can support the rest of the modifiable seat when the modifiable seat is positioned on a surface, with the back frame 14 oriented generally horizontally, and with the first support member 46*a* and the second support member 46*b* each oriented generally vertically and below the back frame 14.

Referring now to FIGS. 1, 1A, 2, and 2C, in some embodiments extenders 48 on the back frame 14 allow a user 11 to adjust the height of the back frame 14. The extenders 48 may be locking clamp extenders 48 or, in an alternate embodiment may be pin lock extenders 148, as shown in FIG. 2B. A pin lock extender 148 comprises a plurality of adjusting holes 50 disposed along the back frame 14 and a spring pin 52.

As shown in FIGS. 1A and 1D, for example, the modifiable seat is configurable in a first configuration so that the upper frame 16 and fabric 30 supported thereby may be positioned above the user 11 when the user 11 is using the modifiable seat. When the modifiable seat is configured in the first configuration, the upper frame 16 and fabric 30 supported thereby are oriented to shield the user 11 from precipitation, sunlight or other potential nuisances landing 30, on the modifiable seat from a direction generally above the modifiable seat (e.g., oriented so that the upper frame 16 and fabric 30 supported thereby, combined, are generally in the shape of (and orientated as) a polygon with a surface that is generally parallel to the ground and perpendicular to the path of sunlight shining or rain falling from above). The bottom frame 12 and fabric 30 supported thereby is positioned below the user 11, so that the user 11 may sit on this part of the modifiable seat. Other parts of the modifiable seat, including other portions of the seat frame 10, the fabric 30, the unfurled curtains 32, and the rain shield 38 (shown in FIG. 1B), are positioned next to and around the user and provide additional shielding and protection from precipitation, sunlight or other potential nuisances, including from precipitation that may be blown by wind in a horizontal direction towards the user 11 and the modifiable seat.

Several other configurations of the modifiable seat are possible. For example, in the second configuration, shown in FIG. 7, the first support member 46*a* and the second support member 46*b* are positioned as shown (i.e., unfolded), positioned generally perpendicular to and below the back frame 14, and support the modifiable seat on a surface so that a user 11 (shown in FIG. 1D) may sit or recline on the modifiable seat, with the curtains 32 furled.

Figure 8:
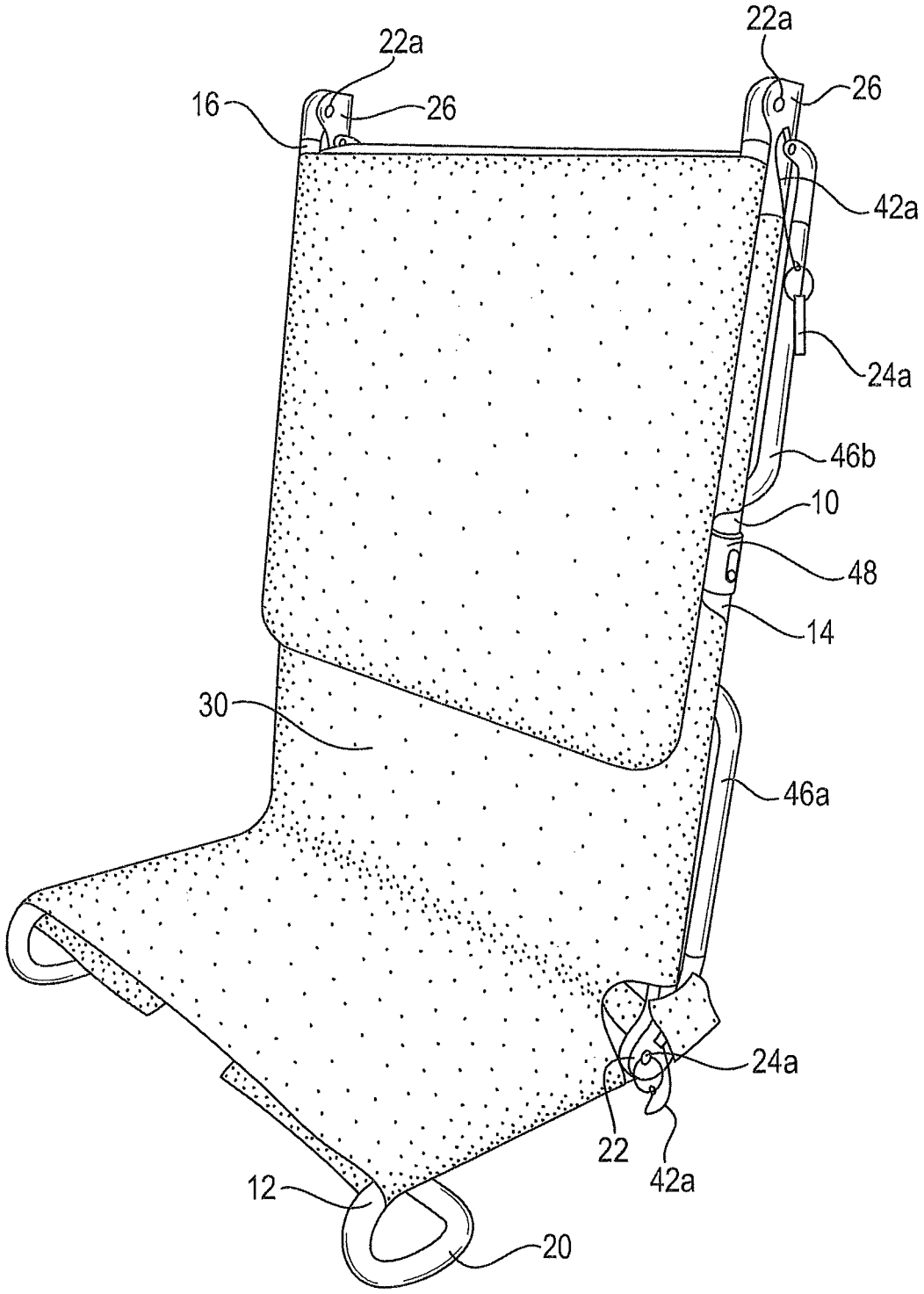
FIG. 8 is an isolinear view of an alternate embodiment of a modifiable seat in accordance with the present application, where the upper frame and support members are folded against the back frame, and the curtains are furled.

The third configuration, shown in FIG. 8, allows for seating of a user 11 (shown in FIG. 1D) with the upper frame 16, first support member 46*a*, and second support member 46*b* positioned as shown (i.e., with first support member 46*a*, second support member 46*b*, and the upper frame 16 folded against the back frame 14 so that a user sitting in the modifiable seat may lean back against the upper frame 16), and with curtains 32 furled.

Figure 9:
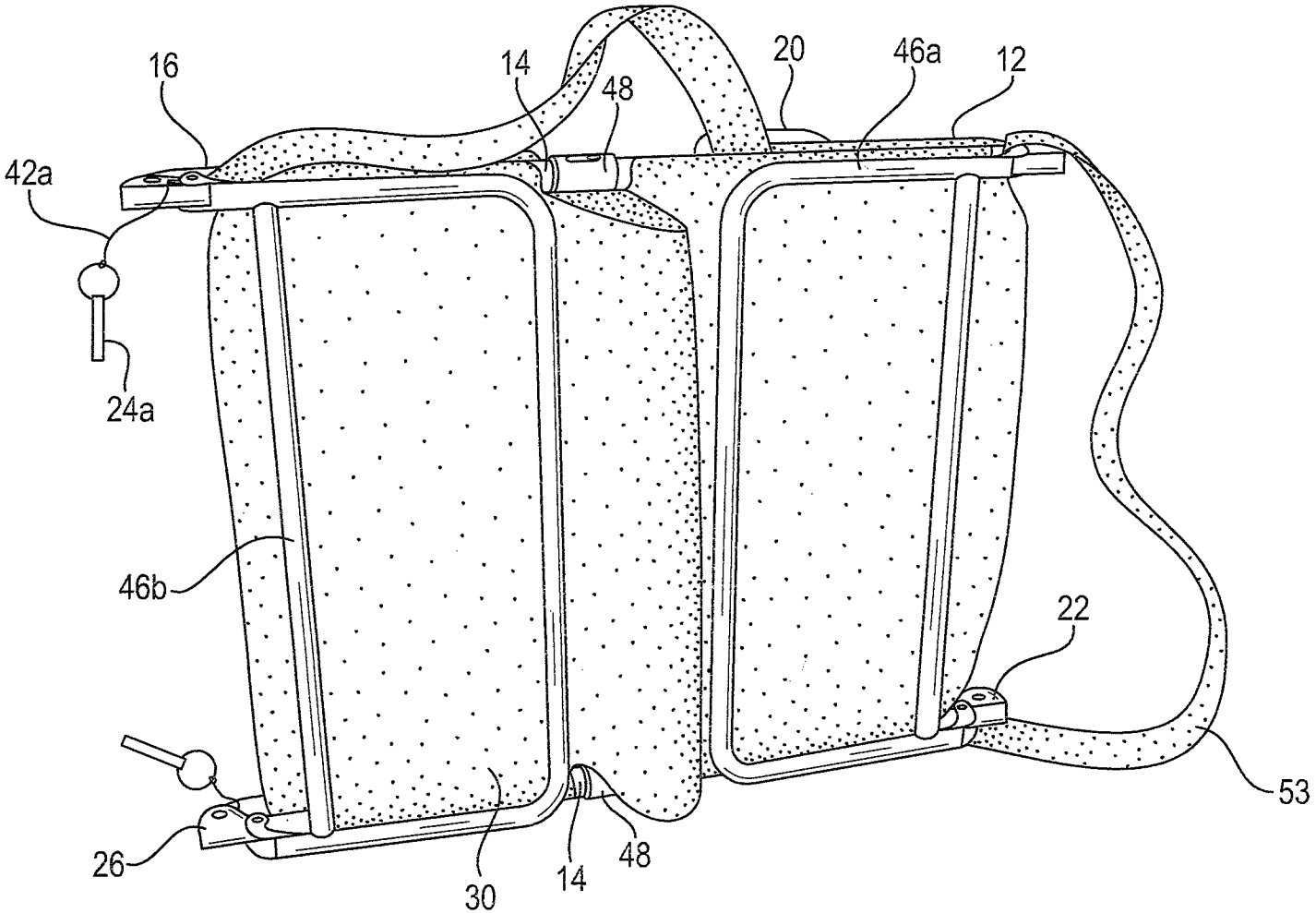
FIG. 9 is a view of an alternate embodiment of a modifiable seat in accordance with the present application where the modifiable seat is folded (i.e., the upper frame, bottom frame, and support members are folded against the back frame and the curtains are furled) for storage or transportation, and with a strap disposed on the frame of the modifiable seat.

In a fourth configuration, shown in FIG. 9, the upper frame 16, bottom frame 12, first support member 46*a*, second support member 46*b* are positioned as shown (i.e., all folded against the back frame 14), and with curtains 32 furled, allowing for the modifiable seat to be easily stored or transported.

In one embodiment, at least one strap 53 disposed on the seat frame 10 allows for carrying the modifiable seat or for hanging the modifiable seat for storage when, for example, the modifiable seat is in the fourth configuration shown in FIG. 9.

From the description above, advantages of the invention become evident in that it allows for a more comfortable seating experience than existing modifiable seats.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A modifiable seat, configurable for use as a seat by a user, comprising:

a seat frame with a bottom frame, a back frame, an upper frame, and at least one frame opening defined by the contours of at least a portion of said seat frame;

a bleacher hook disposed on said bottom frame as a continuous extension of said bottom frame, said bleacher hook comprising a semicircular bleacher hook or a squared crook bleacher hook;

at least two lower hinges pivotably connecting said bottom frame to said back frame;

at least two lower brackets connected to and supporting said bottom frame and removably connected to said back frame;

at least two upper hinges pivotably connecting said back frame to said upper frame;

at least two upper brackets pivotably connected to said back frame and removably connected to said upper frame;

a first support member pivotably connected to said lower hinges;

a second support member pivotably connected to said upper hinges;

a fabric disposed over at least a portion of said seat frame and said at least one frame opening;

at least one curtain extending from said fabric; and configurable in a first configuration where at least a portion of said fabric is positioned over said user and said at least one curtain is positioned next to said user, a second configuration where said first support member and said second support member are positioned generally perpendicular to and below said back frame, a third configuration with said upper frame, said first support member, and said second support member folded against said back frame, and a fourth configuration with said upper frame, said bottom frame, said first support member, and said second support member folded against said back frame, with said curtains furled.

2. The modifiable seat of claim 1, where said curtain further comprises at least one window.

3. The modifiable seat of claim 1, where said fabric further comprises at least one pocket.

4. The modifiable seat of claim 1, where said fabric is attached to said seat frame by a plurality of tubes disposed on at least a portion said fabric.

5. The modifiable seat of claim 4 where said fabric is removably attached to said seat frame by fasteners disposed on at least a portion said tubes.

6. The modifiable seat of claim 1 further comprising a rain shield with a rain shield rod couplable with said at least one curtain.

7. The modifiable seat of claim 1, where said back frame further comprises at least one extender for adjusting the height of said back frame.

8. The modifiable seat of claim 1, wherein said at least two lower brackets connected to and supporting said bottom frame are removably connected to said back frame by at least one bracket pin.

9. The modifiable seat of claim 8, where said at least one bracket pin is tethered to said modifiable seat with a tether.

10. The modifiable seat of claim 1, where a clip is disposed on each said upper bracket.

11. The modifiable seat of claim 1, where said upper frame further comprises a lumbar support curve.

12. The modifiable seat of claim 1, further comprising an umbrella holder.

13. The modifiable seat of claim 1, further comprising a strap disposed on said seat frame.

14. The modifiable Seat of claim 1, where said seat frame further comprises at least one screw hole, and where said fabric is removably attached to said seat frame by at least one fastening screw penetrating at least a portion said fabric and engaging with said screw hole.

15. A modifiable seat, configurable for use as a seat by a user, comprising:

a seat frame with a bottom frame, a back frame, an upper frame, and at least one frame opening defined by the contours of at least a portion of said seat frame;

a bleacher hook disposed on said bottom frame as a continuous extension of said bottom frame, said bleacher hook comprising a semicircular bleacher hook or a squared crook bleacher hook;

at least two lower hinges pivotably connecting said bottom frame to said back frame;

at least two folding brackets each pivotably connected to and supporting said bottom frame and pivotably connected to and supporting said back frame;

at least two upper hinges pivotably connecting said back frame to said upper frame;

at least two folding brackets each pivotably connected to and supporting said back frame and pivotably connected to and supporting said upper frame;

a first support member pivotably connected to said lower hinges;

a second support member pivotably connected to said upper hinges;

a fabric disposed over at least a portion of said seat frame and said at least one frame opening;

at least one curtain extending from said fabric; and configurable in a first configuration where at least a portion of said fabric is positioned over said user and said at least one curtain is positioned next to said user, a second configuration where said first support member and said second support member are positioned generally perpendicular to and below said back frame, a third configuration with said upper frame, said first support member, and said second support member folded against said back frame, and a fourth configuration with said upper frame, said bottom frame, said first support member, and said second support member folded against said back frame, with said curtains furled.

16. The modifiable seat of claim 15, where said curtain further comprises at least one window.

17. The modifiable seat of claim 15, where said fabric further comprises at least one pocket.

18. The modifiable seat of claim 15, where said fabric is attached to said seat frame by a plurality of tubes disposed on at least a portion said fabric.

19. The modifiable seat of claim 18 where said fabric is removably attached to said seat frame by fasteners disposed on at least a portion said tubes.

20. The modifiable seat of claim 15 further comprising a rain shield with a rain shield rod couplable with said at least one curtain.

21. The modifiable seat of claim 15, where said back frame further comprises at least one extender for adjusting the height of said back frame.

22. The modifiable seat of claim 15, where said upper frame further comprises a lumbar support curve.

23. The modifiable seat of claim 15, further comprising an umbrella holder.

24. The modifiable seat of claim 15, further comprising a strap disposed on said seat frame.

25. The modifiable seat of claim 15, where said seat frame further comprises at least one screw hole, and where said fabric is removably attached to said seat frame by at least one fastening screw penetrating at least a portion said fabric and engaging with said screw hole.

26. A modifiable seat, configurable for use as a seat by a user, comprising:

a seat frame with a bottom frame, a back frame, an upper frame, and at least one frame opening defined by the contours of at least a portion of said seat frame;

a bleacher hook disposed on said bottom frame as a continuous extension of said bottom frame, said bleacher hook comprising a semicircular bleacher hook or a squared crook bleacher hook;

at least two lower hinges with locking pinholes pivotably connecting said bottom frame to said back frame;

at least two upper hinges with locking pinholes pivotably connecting said back frame to said upper frame;

a plurality of support pins removably coupled with and capable of locking said lower hinges and said upper hinges;

a first support member pivotably connected to said lower hinges;

a second support member pivotably connected to said upper hinges;

a fabric disposed over at least a portion of said seat frame and said at least one frame opening;

at least one curtain extending from said fabric; and configurable in a first configuration where at least a portion of said fabric is positioned over said user and said at least one curtain is positioned next to said user, a second configuration where said first support member and said second support member are positioned generally perpendicular to and below said back frame, a third configuration with said upper frame, said first support member, and said second support member folded against said back frame, and a fourth configuration with said upper frame, said bottom frame, said first support member, and said second support member folded against said back frame, with said curtains furled.

27. The modifiable seat of claim 26, where said curtain further comprises at least one window.

28. The modifiable seat of claim 26, where said fabric further comprises at least one pocket.

29. The modifiable seat of claim 26, where said seat frame further comprises at least one screw hole, and where said fabric is removably attached to said seat frame by at least one fastening screw penetrating at least a portion said fabric and engaging with said screw hole.

30. The modifiable seat of claim 26 further comprising a rain shield with a rain shield rod couplable with said at least one curtain.

31. The modifiable seat of claim 26, where said back frame further comprises at least one extender for adjusting the height of said back frame.

32. The modifiable seat of claim 26, where said support pins are each tethered to said modifiable seat with a tether.

33. The modifiable seat of claim 26, where said upper frame further comprises a lumbar support curve.

34. The modifiable seat of claim 26, further comprising an umbrella holder.

35. The modifiable seat of claim 26, further comprising a strap disposed on said seat frame.

36. The modifiable seat of claim 26, where said fabric is attached to said seat frame by a plurality of tubes disposed on at least a portion said fabric.

37. The modifiable seat of claim 36 where said fabric is removably attached to said seat frame by fasteners disposed on at least a portion said tubes.

* * * * *